United States Patent [19]

Billmeyer et al.

[11] 4,095,581

[45] Jun. 20, 1978

[54] FIREPLACE CONSTRUCTION

[75] Inventors: Thomas F. Billmeyer; Francis L. Faehling, both of Wisconsin Rapids, Wis.

[73] Assignee: Preway Inc., Wisconsin Rapids, Wis.

[21] Appl. No.: 604,613

[22] Filed: Aug. 14, 1975

[51] Int. Cl.[2] ..... F24B 7/00

[52] U.S. Cl. ..... 126/121; 126/120; 126/143

[58] Field of Search ..... 126/120, 121, 129, 131, 126/143, 138, 140, 202, 63

[56] References Cited

U.S. PATENT DOCUMENTS

| | | | |
|---|---|---|---|
| 1,526,791 | 2/1925 | Johnson | 126/121 |
| 1,587,227 | 6/1926 | Hallberg | 126/121 |
| 2,243,751 | 5/1941 | Donley | 126/121 |
| 2,814,287 | 11/1957 | Shults | 126/140 |
| 2,863,443 | 12/1958 | Hoffman | 126/121 |
| 3,094,980 | 6/1963 | Inabniy | 126/121 |
| 3,162,188 | 12/1964 | Tompers | 126/140 |
| 3,368,545 | 2/1968 | Ibbitson | 126/121 |
| 3,664,325 | 5/1972 | Malafouris | 126/121 |
| 3,845,754 | 11/1974 | Wilkening | 126/121 |
| 3,926,174 | 12/1975 | Bell | 126/121 |
| 3,976,048 | 8/1976 | Ashman, Jr. | 126/143 |
| 4,013,059 | 3/1977 | Andrews | 126/120 |

FOREIGN PATENT DOCUMENTS

| | | | |
|---|---|---|---|
| 673,959 | 6/1952 | United Kingdom | 126/120 |
| 737,465 | 9/1955 | United Kingdom | 126/121 |

*Primary Examiner*—William F. O'Dea
*Assistant Examiner*—Harold Joyce
*Attorney, Agent, or Firm*—Wegner, Stellman, McCord, Wiles & Wood

[57] ABSTRACT

A prebuilt fireplace construction for installation in a building structure, such as a mobile home. The construction includes a firebox having an open side and a combustion gas outlet adapted to be placed in fluid communication with a flue. A transparent door is provided for substantially sealing the open side and a housing at least partially surrounds the firebox in close proximity thereto to define an air space therebetween. The air space has a relatively low inlet and a relatively high outlet. A conduit isolated from the air space is provided and is adapted to be placed in fluid communication with a source of outside air. The conduit opens into the firebox to provide combustion air. A baffle is interposed between the opening of the conduit into the firebox and the combustion area thereof.

1 Claim, 9 Drawing Figures

156
156
54
54
128
160
150
158
172
174
172
166
170

164

150
180
130
130
182
128
124
122
184
126
66
68

FIREPLACE CONSTRUCTION

BACKGROUND OF THE INVENTION

This invention relates to fireplace constructions, and, more specifically, to prebuilt constructions adapted to be located in structures such as mobile homes or the like.

The use of preconstructed fireplace constructions is on the increase because of the ease of installation of such constructions in a building structure. This is particularly true in the case of mobile homes where, because of the ever present possibility that the home will be moved, it is undesirable to resort to relatively permanent, masonry construction employed in conventional fireplaces.

In such preconstructed fireplaces, since masonry is not employed to any great extent, it is desirable to provide an air space surrounding the firebox for insulation purposes and for providing a source of heat through connection currents to the structure in which the fireplace construction is housed.

It is also desirable in certain structures, such as in mobile homes, that fireplaces employed therein be provided with a source of outside air to preclude the possibility of oxygen starvation within the structure due to the combustion reaction itself.

SUMMARY OF THE INVENTION

It is the principal object of the invention to provide a new and improved preconstructed fireplace construction. More specifically, it is an object of the invention to provide such a structure suitable for use in mobile homes or the like.

According to one aspect of the invention in the broadest sense, the foregoing objects are achieved in a construction including a firebox having an open side and a combustion gas outlet adapted to be in fluid communication with a flue. A transparent door is provided for substantially sealing the open side to preclude products of combustion from exiting into the structure in which the fireplace construction is housed. A housing at least partially surrounds the firebox in close proximity thereto to provide an air space between the firebox and the housing. An inlet is located in the housing through which air in the structure housing the fireplace may enter the housing. An outlet is provided through which air in the housing can exit to re-enter the structure. The housing inlet and outlet define a first air flow path. Means are provided for introducing air from a point exterior of the structure to the interior of the firebox, thereby establishing a second air flow path isolated from the firt air flow path to provide a source of combustion air and for eliminating the possibility that products of combustion may enter the first air flow path to be discharged into the structure housing the fireplace.

According to another aspect of the invention in its broadest sense, the foregoing objects are achieved in a fireplace construction having a housing and a firebox as mentioned previously. A conduit in fluid communication with an opening in the firebox is adapted to be connected to a source of air exteriorly of the structure and the conduit extends exteriorly of the housing. A fixed baffle within the firebox is disposed across the opening of the conduit into the housing to diffuse combustion air to thereby enhance combustion and preclude the possibility of sparks, cinders, or the like from entering the exterior air conduit.

Other features of the invention employable with structures made according to either aspect of the invention as aforesaid, include the locating of the opening of the conduit for the exterior air in the firebox adjacent the lower extremity of the firebox.

It is also desirable that the baffle be constructed, in some instances, to permit air to enter into the upper portion of the firebox to provide an improved draft.

According to one embodiment of the invention, the conduit extends generally horizontally through the housing to simplify installation. According to another embodiment, the conduit extends generally vertically downwardly through the housing and this embodiment is particularly suitable for use in structures having a ventilated crawl space.

According to another embodiment of the invention, the opening of the conduit for the external air may be located below the door and a hearth structure employed to overlie and house the conduit for the exterior air.

Other objects and advantages will become apparent from the following specification taken in connection with the accompanying drawings.

DESCRIPTION OF THE PREFERRED EMBODIMENTS

Figure 1:
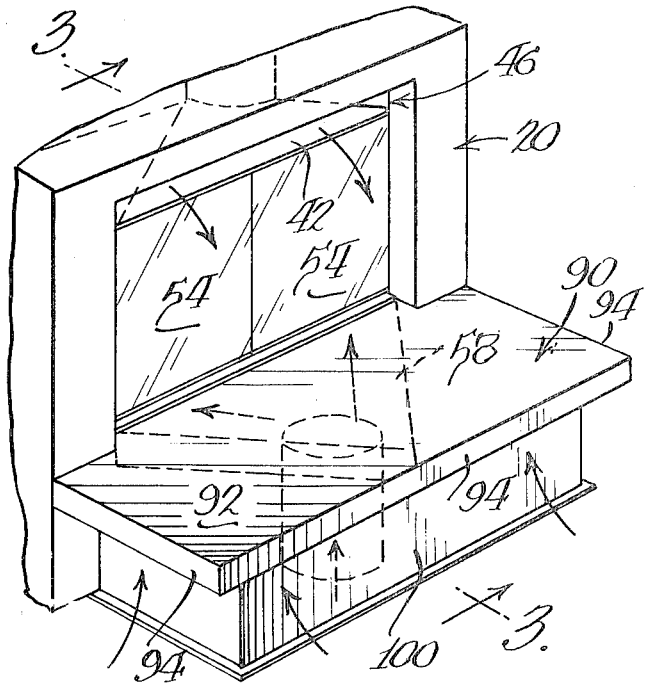
FIG. 1 is a fragmentary, perspective view of one embodiment of a fireplace construction made according to the invention.
Figure 2:
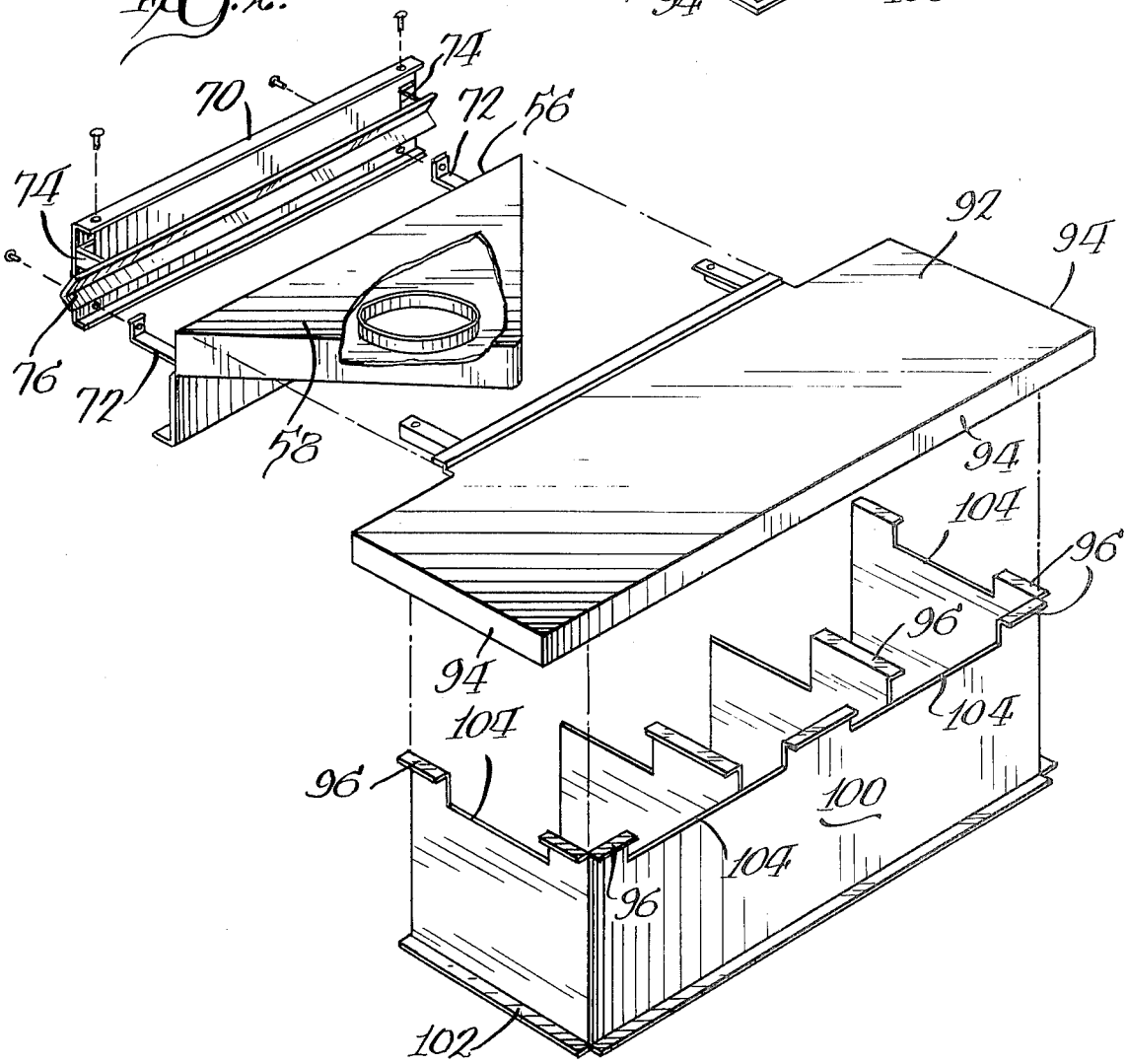
FIG. 2 is an exploded, perspective view of a hearth structure employed in the embodiment illustrated in FIG. 1.
Figure 3:
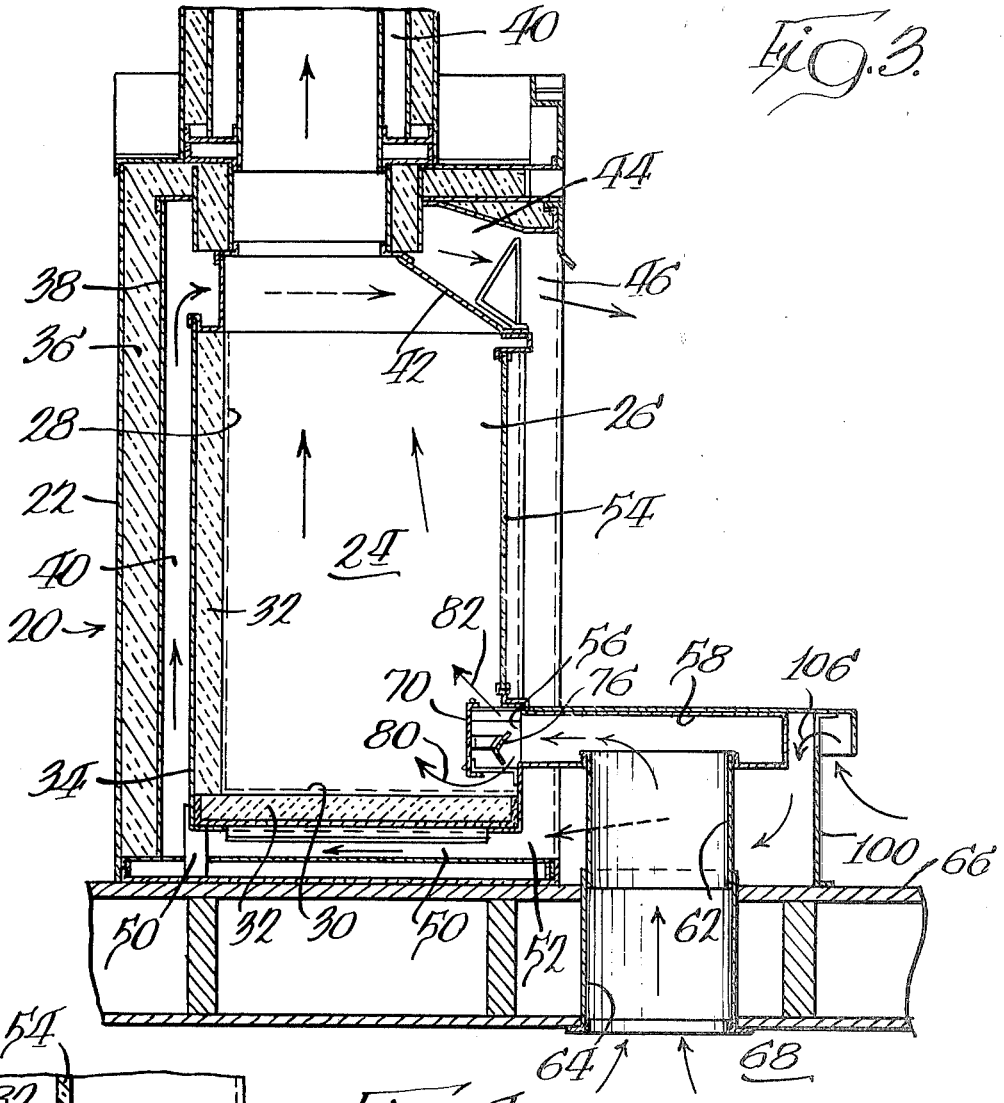
FIG. 3 is a vertical section taken approximately along the line 3—3 of FIG. 1.

One embodiment of a fireplace construction made according to the invention is illustrated in FIGS. 1–4, inclusive, and with specific reference to FIGS. 1 and 3, is seen to include a housing, generally designated 20, formed of sheet metal walls 22 or the like. Within the housing 20 is a firebox 24 having side walls 26, or rear wall 28 and a bottom wall 30. The walls 28 and 30 are backed by refractory block 32 for insulating purposes and the blocks 32 are, in turn, backed by sheet metal 34 for protective purposes.

Inwardly of the sheet metal wall 22 of the housing 20 is a mass of insulating material 36 which is backed by sheet metal 38 spaced from the backing 34 for the refractory 32. As a consequence, an air space 40 between the firebox 24 and the housing 20 is defined. Within the housing 20, and above the firebox 24, is a hood 42 defining an outlet from the firebox 24 for combustion gases and which is adapted to be in fluid communication with a flue 40 extending to the interior of the structure in which the fireplace is located. The hood 42 is configured to narrow progressively from its lower extent to its upper so that a continuation 44 of the air space 40 is provided and such that an outlet 46 from the air space 40 is defined by the forwardmost edge of the hood 42, the forwardmost upper edge of the housing 20 and the upper extremities of the side walls of the housing 20.

As best seen in FIG. 3, the firebox 24 is provided with feet 50 raising the same above the lower extremity of the housing 20 to provide a further continuation 50 of the air space 40. The lower, forwardmost edge of the firebox 24 in connection with the lower forwardmost edge of the housing 20 and the side walls thereof define an inlet 52 to the air space.

The remaining, open side of the firebox 24 is adapted to be substantially sealed by means of two transparent doors 54 suitably hinged for movement about vertical axes between open and closed positions.

Figure 4:
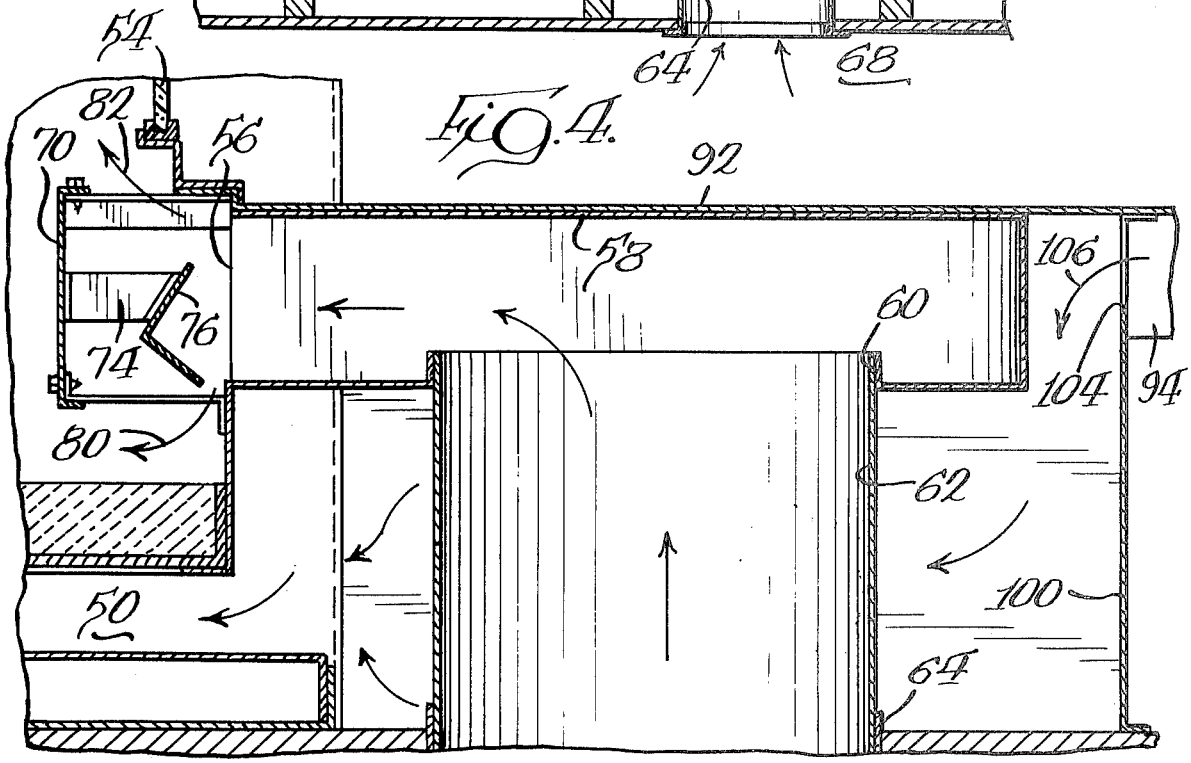
FIG. 4 is a fragmentary, vertical section of the hearth structure and a portion of the fireplace construction.

Just below the doors 54, as best seen in FIGS. 3 and 4, an opening 56 to the firebox 24 near its lower extremity is provided by the open end of a pyramid shaped duct 58. The duct 58 includes a downwardly facing opening 60 for receipt of a cylindrical duct 62, the lower end of which may be received in a duct 64 extending through the floor 66 of the structure housing the fireplace into a suitably ventilated crawl space 68 therebelow. As a consequence, the ducts 58, 62 and 64 define an air flow path from the exterior of the structure to the interior of the firebox 24 near the lower extremity of the latter for the admission of combustion air from a location exterior of the structure.

A vertically oriented, horizontally elongated, deflector 70 is mounted on spaced brackets 72 secured to the pyramid shaped duct 58 in spaced relation to the open base thereof for the purpose of preventing sparks, cinders, or the like from entering into the duct 58. Brackets 74 mounted on the deflector 70, in turn, mount a V-shaped baffle 76 in proximity to the opening 56 so that outside air passing through the aforementioned flow path will impinge upon the baffle 76 to deflect downwardly in the direction of a arrow 80 as illustrated in FIGS. 3 and 4, as well as upwardly in the direction of an arrow 82. The upward air flow will tend to pass along the interior surface of the doors 54 to preclude or minimize the depositing thereon of products of combustion. In other words, the upwardly moving current of air in adjacency to the sides of the doors exposed to the fire tends to keep the doors from clouding due to tars or the like resulting from combustion.

A hearth structure, generally designated 90, is provided to house the ducts 58 and 62. The same includes a horizontally disposed member 92 having downturned sides 94 which may be mounted on horizontally directed flanges 96 on the upper edge of a three-walled support 100. The support 100 is adapted to be disposed on the floor 66 of the structure and is provided with horizontally directed flanges 102 at its lower extremity for that purpose.

The relative dimensioning of the downturned sides 94 and the corresponding walls of the support 100 is such that there is substantial spacing therebetween with the support 100 being located inwardly of the downturned sides 94. The upper edges of the walls of the support 100 include cutouts 104 which are masked from view by the downturned sides 94 and which allow air within the structure housing the fireplace to enter the support 100 as illustrated by arrows 106 in FIGS. 3 and 4. From the interior of the support 100, such air has free access to the inlet 52. Thus, air from he interior of the structure housing the fireplace may enter the air space 40 and, by reason of being heated in the air space 40 when a fire is in progress in the fireplace 42, pass therethrough to the outlet 46 to reenter the structure. Such convection currents perform the dual function of cooling the firebox 24 and providing a source of heat to the structure.

It is also to be noted that the air flow path for interior air is completely isolated from that for exterior air. Consequently, by reason of the sealing of the open side of the fireplace by the doors 54, there is virtually no possibility that products of combustion can enter the structure housing the fireplace. Similarly, air from within the interior of the structure cannot be consumed as combustion air, resulting in the possibility of oxygen starvation.

A modified embodiment of the invention is illustrated in FIGS. 5–8, inclusive, and is seen to include a housing 120 defined by sheet metal walls 122. Spaced inwardly of the sheet metal walls 122 is a similarly shaped sheet metal wall 124 and the area between the walls 122 and 124 receives insulation 36.

Inwardly of the wall 124 is a further wall 128 which defines the wall of the firebox 24 and is indentical in function to the walls 26, 28 and 30 of the embodiment previously described. An air space 126 similar to the air space 40 is defined by the walls 124 and 128.

While not shown in FIGS. 5–8, communication between the air space 126 and the interior of the structure in which the fireplace is housed is established in an identical fashion to that illustrated and described in connection with the embodiment shown in FIGS. 1–4, inclusive.

Figure 5:
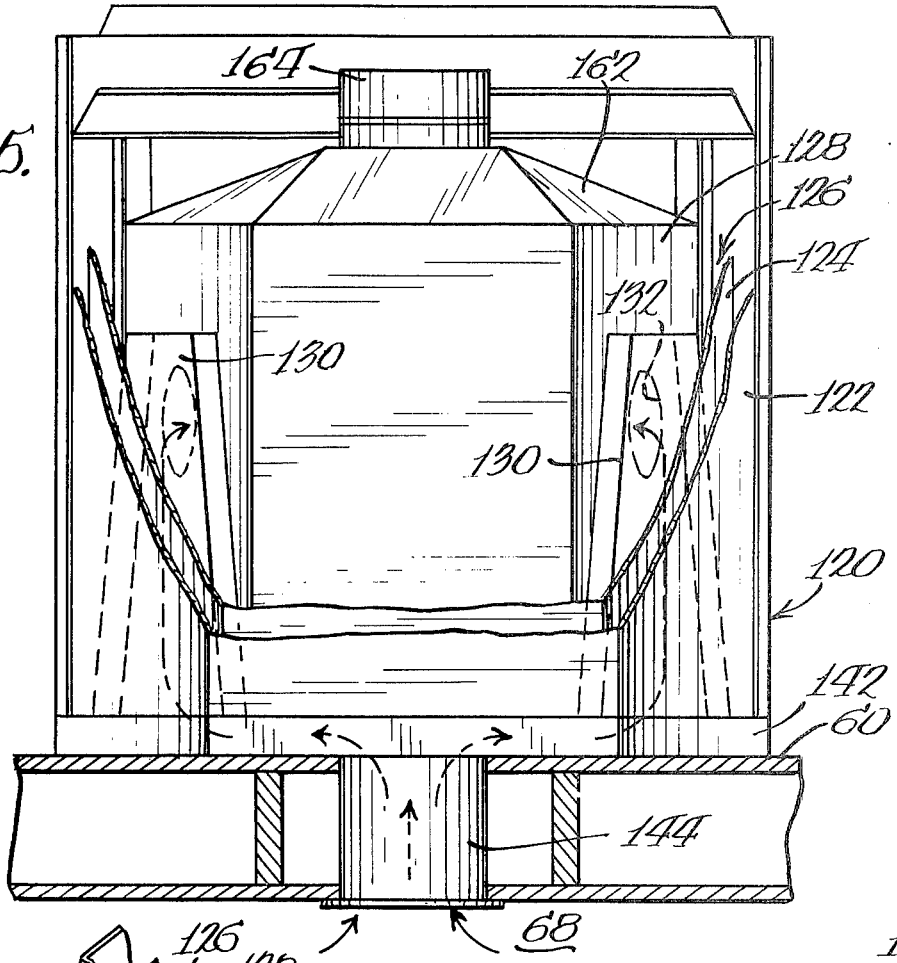
FIG. 5 is a rear view of a modified embodiment of a fireplace made according to the invention with parts broken away for clarity.
Figure 7:
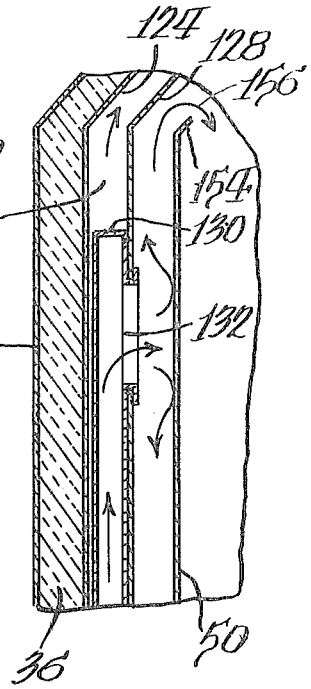
FIG. 7 is a vertical section taken approximately along the line 7—7 of FIG. 6.

As best seen in FIG. 7, a truncated, pyramid-shaped duct 130 is disposed between the walls 124 and 128 and includes an opening 130 to the interior of the firebox defined by the wall 128. The base of the pyramid-shaped duct 130 is open and is adapted to be aligned with a slot 140 in a base member 142 on which the housing 120 is supported. The base member 142 is open bottomed and, as best seen in FIG. 5, is adapted to be disposed over a conduit 144 extending through the floor 60 of the structure to the crawl space 68 thereof so that air from an exterior source may pass upwardly into the base member 142 and thence to the interior of the pyramid-shaped duct 130 and thence through the opening 132 thereof into the firebox defined by the wall 128.

Figure 6:
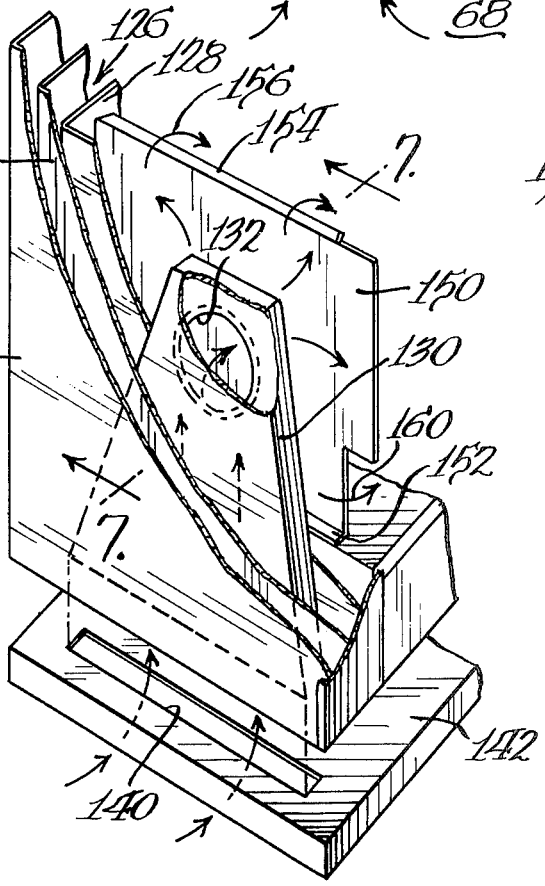
FIG. 6 is a fragmentary, perspective view of a portion of the fireplace illustrated in FIG. 5.
Figure 8:
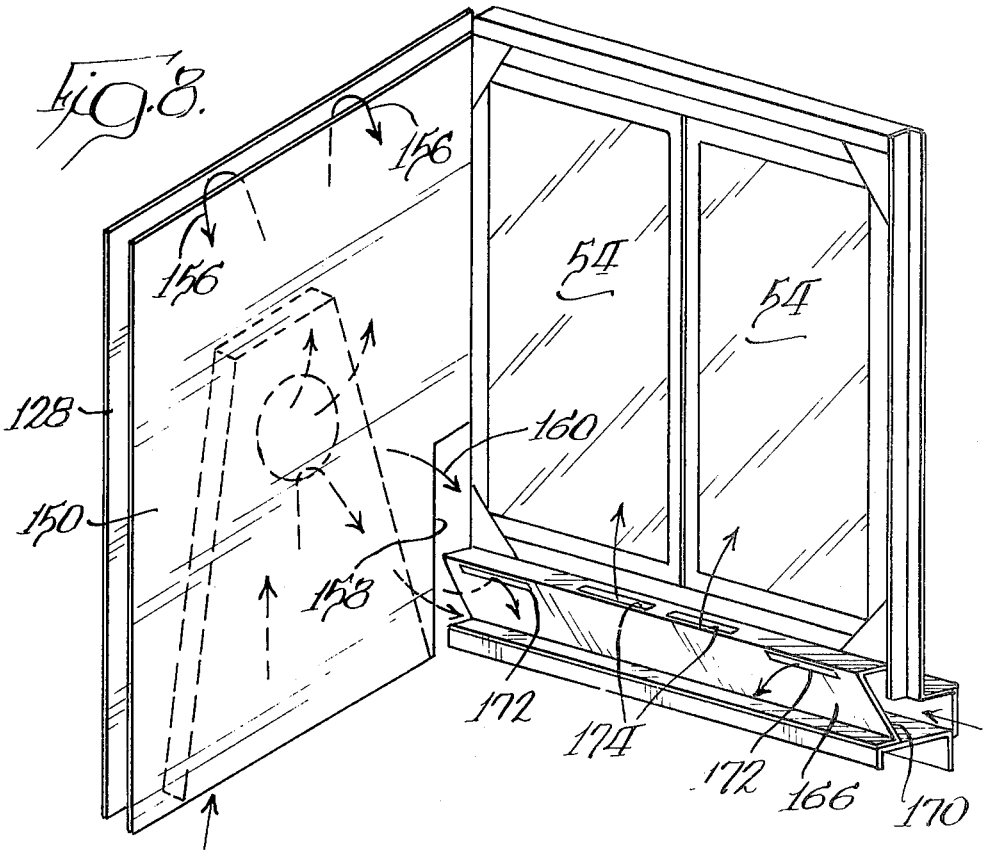
FIG. 8 is a partial, perspective view of the fireplace illustrated in FIG. 5 with parts omitted for clarity.

As best seen in FIGS. 6–8, inclusive, interiorly of the side of the firebox defined by the wall 128 there is disposed a sheet-like baffle 150. A flange 152 substantially seals the lower edge of the baffle 150 against the bottom of the firebox while, as seen in FIG. 7, the upper edge 154 of the baffle 150 is somewhat inwardly directed so that air may pass over the top of the baffle 150, as indicated by an arrow 156 in FIGS. 7 and 8, through he combustion area of the firebox. In addition, adjacent the forward edge of the sheet-like baffle 50 and near the lower extremity thereof, the same is provided with a cutout 158 whereby air may pass as indicated by an arrow 160 in FIGS. 6 and 8 to the combustion area near the lower extremity thereof to promote efficient combustion.

As in the case of the embodiment illustrated in FIGS. 1–4, the firebox is provided with an open side substantially sealed by transparent doors 54 suitably hinged to be movable between open and closed positions. In addition, the firebox is provided with a hood 162 having a combustion gas outlet 164 for connection to a flue.

If desired, a sheet metal structure 166 having open ends 170 adjacent the cutouts 158 may be provided. The sheet metal structure 166 is configured to have downwardly facing vents 172 and upwardly facing vents 174. Air may pass to the interior of the sheet metal structure 166 through the open ends 170 to move upwardly adjacent the doors 54 to preclude accumulation of combustion materials thereon and also may be distributed through the vents 172 to the forward portion of the combustion area.

Again, it will be appreciated that the embodiment of FIGS. 5–8 provides isolated flow paths for interior and exterior air to achieve the goals of the invention.

Figure 9:
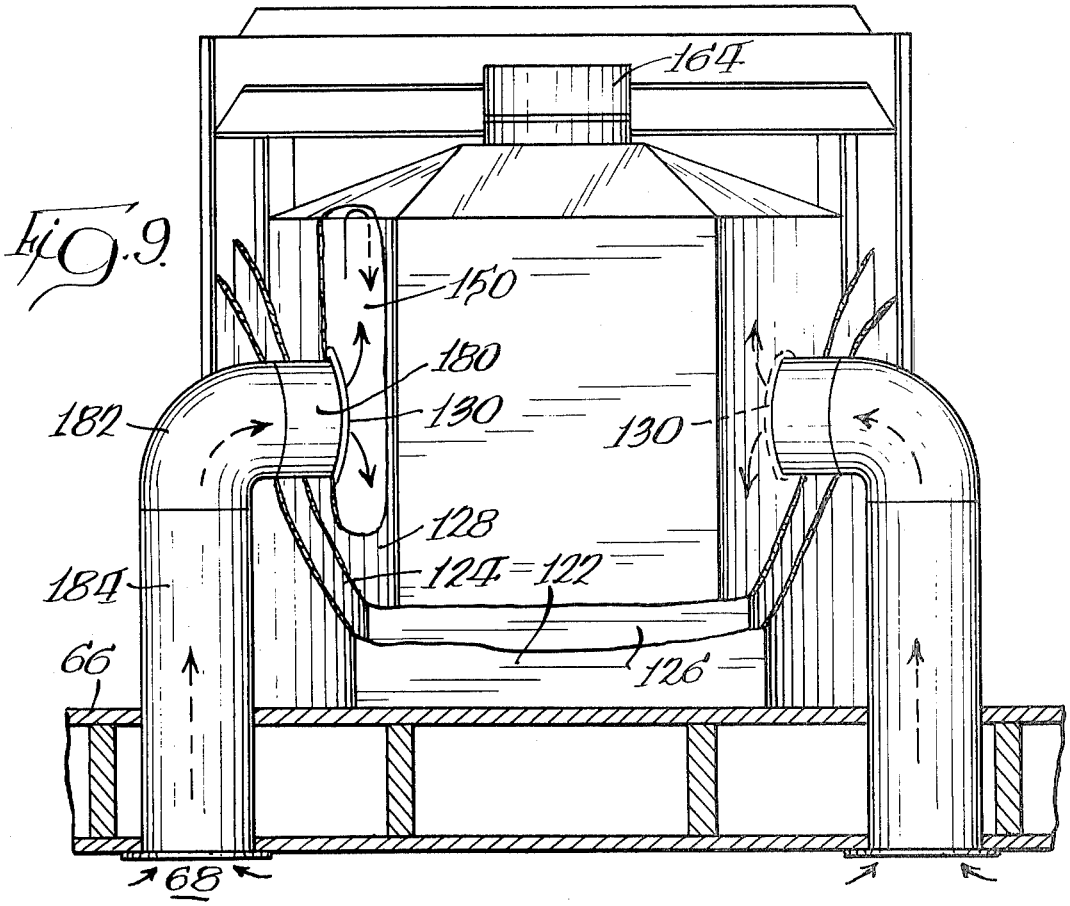
FIG. 9 is a view similar to that of FIG. 5, but of a further modification of the invention.

FIG. 9 illustrates still a further embodiment of the invention which, in all respects save one, is identical to that illustrated in FIGS. 5–8, inclusive.

In the embodiment of FIG. 9, the opening 130 to the area between the baffle 150 and the wall 128 defining the firebox, is provided by one end of a horizontally extending conduit 180 which passes through both the wall 124 and the wall 122. Preferably, the conduit 180 projects beyond the wall 122 a sufficient distance so that the same may be connected to an elbow 182 which, in turn, may be connected to a vertically extending conduit 184 passing through the floor 60 of the structure to the crawl space 68. In the case of te embodiment illustrated in FIG. 9, the base 142 may then be omitted.

Preferably, in the embodiments of FIGS. 5–9, the baffles 150 and appurtenances thereto including the openings and duct work to the exterior of the structure are provided on opposite sides of the firebox, such sides also being adjacent to the open side of the firebox. Such a construction promotes uniformity of air flow and greater efficiency in achieving the objects of the invention.

It will be appreciated that in a fireplace made according to the invention, totally isolated flow paths are established for combustion gases generated by fire combustion with outside air and convection circulated inside air. By reason of the use of the doors 54 substantially sealing the firebox, combustion air must be drawn from the exterior of the structure to preclude the possibility of oxygen starvation to the occupants of the structure. This feature is particularly desirable in relatively airtight structures, such as mobile homes or the like. The use of the baffles precludes substantial clouding of the transparent doors 54 and also precludes hot sparks, or cinders, or the like from being thrown by the fire into the air flow paths to create a fire hazard. In the embodiment illustrated in FIGS. 1–4, the use of the hearth structure 90 provides an aesthetic masking for the outside air conduits. In the embodiment illustrated in FIGS. 5–8, the outside air duct are wholly self-contained within the preconstructed fireplace unit. In the case of the embodiment of FIG. 9, installation of the preconstructed fireplace is greatly simplified in that the conduits 180 are easily connectable to standard duct work.

It will also be appreciated that the isolation of the flow path for outside combustion air precludes the existence of a path of entry into the interior of the structure in which the fireplace is housed for insects or the like.

Finally, in the case of the embodiment illustrated in FIGS. 1–4, it will be recognized that the unique hearth structure may be readily disassembled for cleaning purposes or the like. That is, by simply removing the member 92, simple access to the duct work including the duct 58 and the baffles in the interior thereof may be achieved.

We claim:

1. In a fireplace construction adapted to be housed in a structure, the combination of:

a sheet metal firebox having an open side, two opposite side walls adjacent said open side and a combustion gas outlet adapted to be in fluid communication with a flue, each side wall having an opening formed therein;

a door for substantially sealing said open side;

a sheet metal housing at least partially surrounding said firebox in close proximity hereto;

a relatively low inlet in said housing through which air in a structure housing said fireplace may enter said housing;

a relatively high outlet in said housing through which air in said housing may exit the housing to re-enter the structure housing the fireplace;

said housing, inlet and outlet defining a first air flow path for circulating air;

a pair of conduits each in fluid communication through an opening with the interior of said firebox for establishing second and third air flow paths extending through and isolated from said first air flow path, said conduits extending from a point adapted to be located exteriorly of the structure housing the fireplace to its respective opening in each side wall of said firebox to provide a source of combustion air from a location exterior of the structure housing the fireplace;

a pair of spaced apart vertical sheet metal baffles located within said firebox one spaced from each side wall, each opening being in communication respectively with the space defined between each baffle and side wall, each baffle including a cutout adjacent said open side near the lower extremity thereof and an upper end spaced from the top of said firebox to permit combustion air to pass thereover; and a baffle structure disposed across the lower forward end of said firebox between said baffles, said baffle structure having oppositely disposed open ends and defining passageways for directing air upwardly across the door and downwardly across the bottom of said firebox, the cutouts of said baffles being generally aligned with said open ends of said baffle structure so that combustion air is delivered into said open ends.

* * * * *